US007086883B2

(12) United States Patent
Kuo et al.

(10) Patent No.: US 7,086,883 B2
(45) Date of Patent: Aug. 8, 2006

(54) ELECTRICAL CONNECTOR ASSEMBLY WITH TWO DIELECTRIC HOUSINGS ARRANGEABLE AT DIFFERENT ANGLES

(75) Inventors: Chin Pao Kuo, Tu-chen (TW); Yun Long Ke, Tu-chen (TW); Shih Tung Chang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/863,100

(22) Filed: Jun. 7, 2004

(65) Prior Publication Data

US 2004/0266254 A1 Dec. 30, 2004

(30) Foreign Application Priority Data

Jun. 6, 2003 (TW) ..... 92115465 A

(51) Int. Cl.
*H01R 12/24* (2006.01)

(52) U.S. Cl. ..... 439/171; 439/499

(58) Field of Classification Search ..... 439/31, 439/165, 640, 170–173, 492, 499
See application file for complete search history.

(56) References Cited

U.S. PATENT DOCUMENTS

| | | | | |
|---|---|---|---|---|
| 3,601,746 | A * | 8/1971 | Teagno | 439/31 |
| 4,421,376 | A * | 12/1983 | Cosmos et al. | 439/461 |
| 4,786,260 | A * | 11/1988 | Spaulding | 439/607 |
| 4,959,021 | A * | 9/1990 | Byrne | 439/310 |
| 6,193,522 | B1 * | 2/2001 | Liao | 439/31 |
| 6,273,753 | B1 | 8/2001 | Ko | |
| 6,305,978 | B1 | 10/2001 | Ko | |
| 6,398,597 | B1 | 6/2002 | Ko | |
| 6,406,314 | B1 * | 6/2002 | Byrne | 439/215 |
| 6,663,396 | B1 * | 12/2003 | Wang | 439/31 |

* cited by examiner

*Primary Examiner*—Neil Abrams
(74) *Attorney, Agent, or Firm*—Wei Te Chung

(57) ABSTRACT

An electrical connector assembly in accordance with the present invention includes a first dielectric housing (20), a second dielectric housing (10), a number of terminals (26) and a cable (40) electrically connected with the terminals. The first dielectric housing includes a body (21) and a first retention structure (28) formed at opposite ends of the body. The body defines a plurality of passageways (210). The second dielectric housing includes a base (14) and a second retention structure (12) formed at opposite ends of the base. The second retention structure is engageable with the first retention structure at different angles so that the cable extends along different directions with respect to a mating direction of the electrical connector assembly. The terminals are received in corresponding passageways.

2 Claims, 8 Drawing Sheets

ELECTRICAL CONNECTOR ASSEMBLY WITH TWO DIELECTRIC HOUSINGS ARRANGEABLE AT DIFFERENT ANGLES

BACKGROUND OF THE INVENTION

1. Field of the Invention

The present invention generally relates to an electrical connector assembly having a first and a second dielectric housing engageable with each other.

2. Description or Prior Arts

U.S. Pat. No. 6,398,597 discloses a cable connector assembly usually used for connecting a Liquid Crystal Display with a motherboard of a notebook. The cable connector assembly comprises a dielectric housing, a plurality of terminals received in the dielectric housing, a shield enclosing the dielectric housing and a cable electrically connecting with the terminals. A mating direction of the cable connector assembly with a complementary connector is parallel to a direction in which the cable extends. However, because of some reason, such as the limitation of the space inside the notebook or the difficulty in arranging the cable, the mating direction of the cable connector assembly sometimes needs to be perpendicular to a direction in which the cable extends.

Usually one solution to the problem mentioned above is that a cable connector assembly, of which a mating direction with a complementary connector is perpendicular to a direction along which cable extends, is redesigned. However, the solution previously proposed needs to employ a new different mold to produce a dielectric housing of the cable connector assembly, thereby increasing the cost of manufacture and wasting a lot of time to design the new mold.

Hence, it is desirable to have an improved cable connector assembly to overcome the above-mentioned disadvantages of the prior art.

BRIEF SUMMARY OF THE INVENTION

Accordingly, an object of the present invention is to provide an electric connector assembly having a first and a second dielectric housing engageable with each other in different directions for different requirement.

In order to achieve the above-mentioned object, an electrical connector assembly in accordance with the present invention comprises a first dielectric housing, a second dielectric housing, a plurality of terminals received in the first dielectric housing and a cable electrically connected which the terminals. The first dielectric housing comprises a body and a first retention structure formed at opposite ends of the body. The body defines a plurality of passageways. The second dielectric housing comprises a base and a second retention structure formed at opposite ends of the base. The second retention structure is engageable with the first retention structure at different angles so that the cable extends along different directions with respect to a mating direction of the electrical connector assembly. The terminals are received in corresponding passageways.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
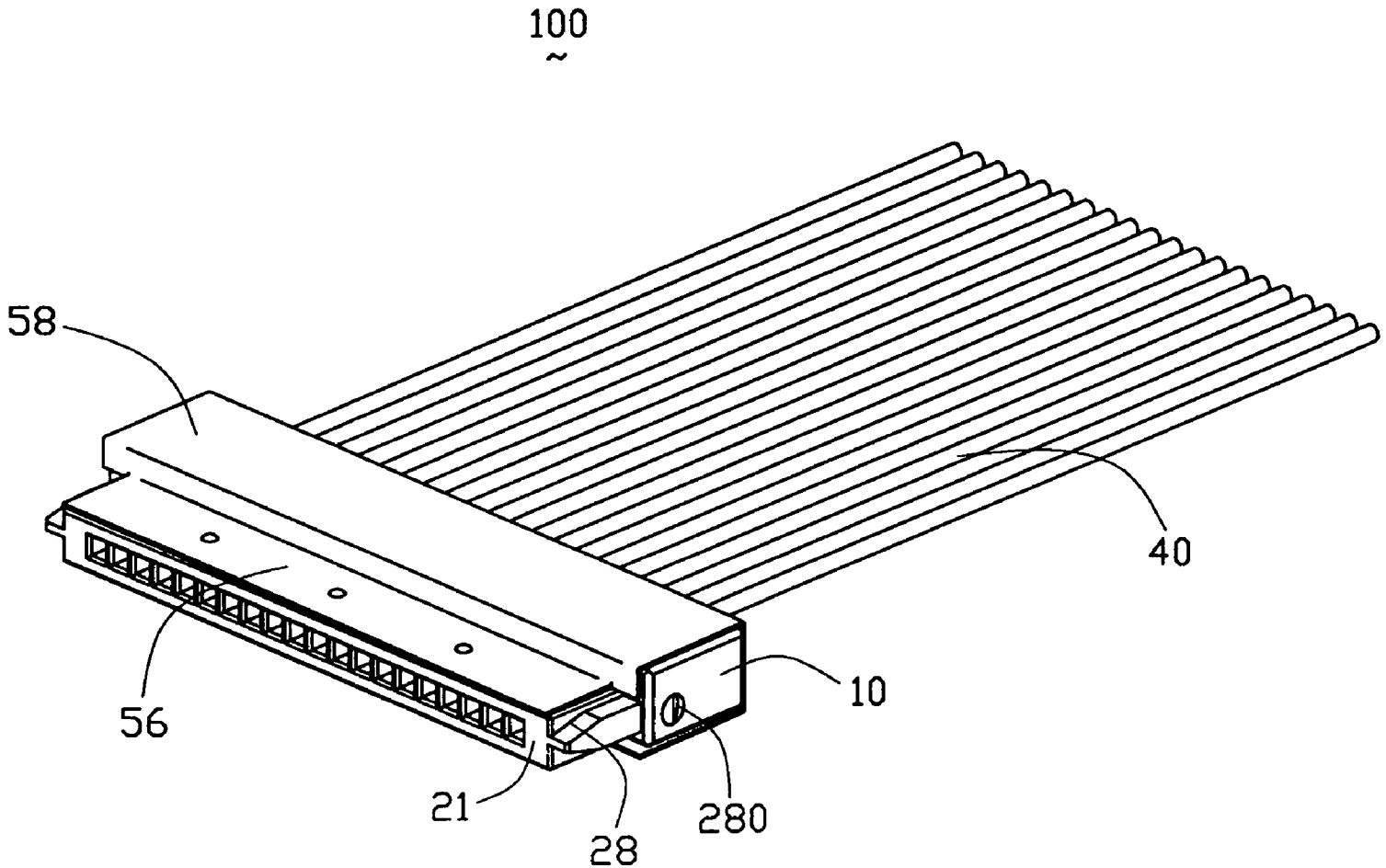
FIG. 1 is a perspective view of a cable connector assembly in accordance with a first embodiment of the present invention.

Reference will now be made to the drawing figures to describe the present invention in detail.

Referring to FIGS. 1–4, a cable connector assembly 100 in accordance with the present invention comprises a first dielectric housing 20, a second dielectric housing 10 assembled to the first dielectric housing 20, a plurality of terminals 26 received in the first dielectric housing 20, a cable 40, a shield enclosing the first and second dielectric housing 20, 10.

Figure 5:
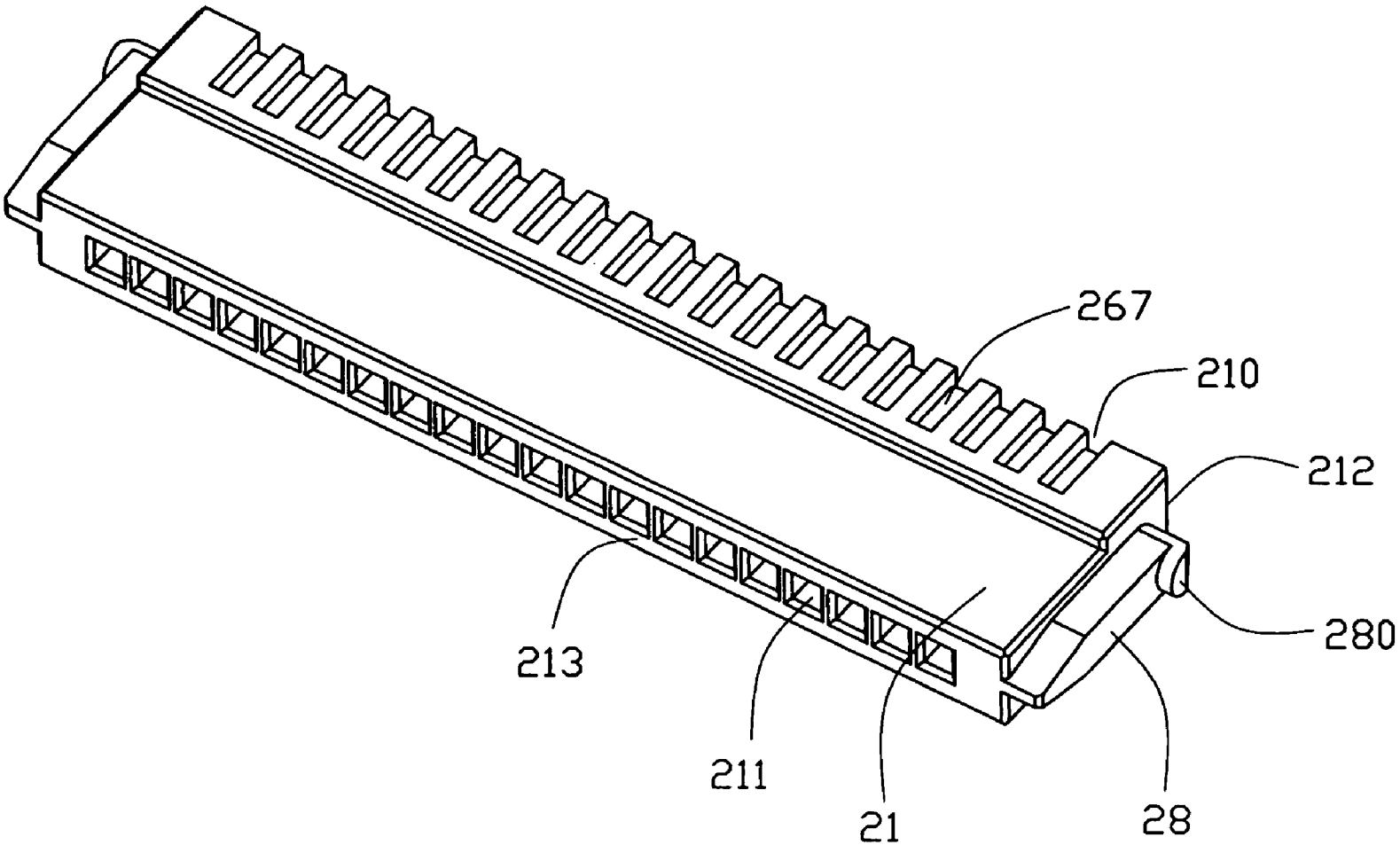
FIG. 5 is a perspective view of a first dielectric housing.

Referring to FIG. 5, the first dielectric housing 20 comprises an elongated body 21 and a first retention structure 28 formed at opposite sides of the body 21. The body 21 defines a plurality of notches 210 periodically spaced along a longitude direction in a rear face 212 thereof, and a plurality of passageways 211 extending from a mating face 213 thereof and communicating with the corresponding notches 210. The first retention structure 28 as is discloses in the preferred embodiment of the present invention comprises a pair of ribs and a post 280 adjacent to each rib.

Figure 6:
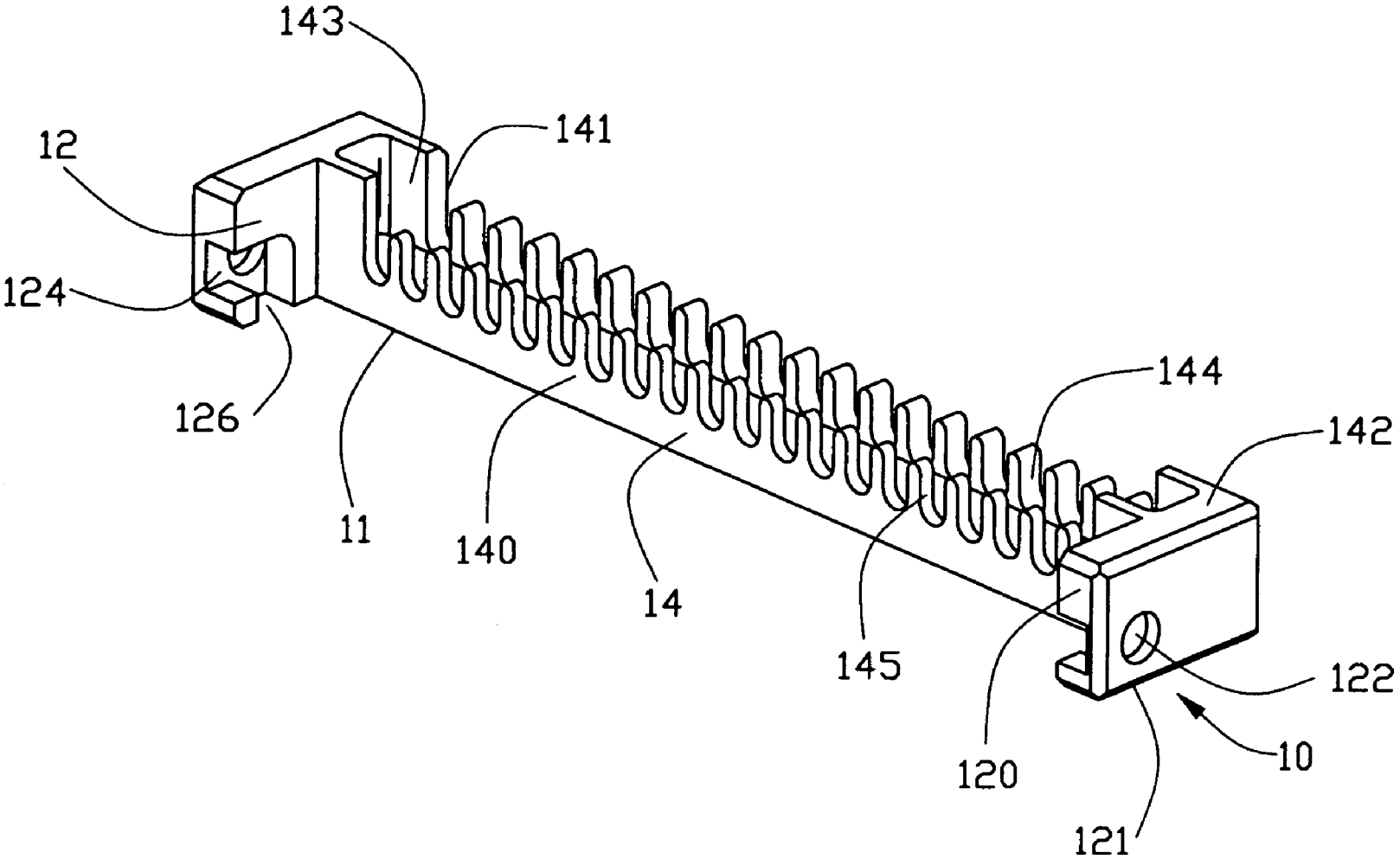
FIG. 6 is a perspective view of a second dielectric housing.

Referring to FIG. 6, the second dielectric housing 10 comprises an elongated base 14 and a second retention structure 11 formed at opposite sides of base 14. The base 14 has a front face 140, an opposite rear face 141 and an upper face 142 interconnecting the front and rear face 140, 141. The base 14 defines a slot 143 extending in the upper face 142, a plurality of first channels 144 periodically spaced along a longitudinal direction of the base 14 through the rear face 141 and a plurality of second channels 145 periodically spaced along a longitudinal direction of the base 14 through the front face 140. The first and second channels 144, 145 are aligned with each other and both communicate with the slot 143. The second retention structure 12 is, as shown in FIG. 6, preferably a pair of arms extending forwardly from the opposite sides of the base 14. The pair of arms 12 defines a receiving space 11 therebetween. Each arm 12 has a front face 120 and a lower face 121 perpendicular to the front face 120. Each arm 12 defines a hole 122 communicating with the receiving space 11, a first recess 124 extending from the front face 120 in an inner face thereof, and a second recess 126 extending from the lower face 121 in an inner face thereof. The first and second recesses 124, 126 are perpendicular to the first recess 124 and both communicate with the hole 122. Of course, the first recess 124 can define an angle from 0 degree to 180 degree with respect to the second recess 126, if desired.

Figure 2:
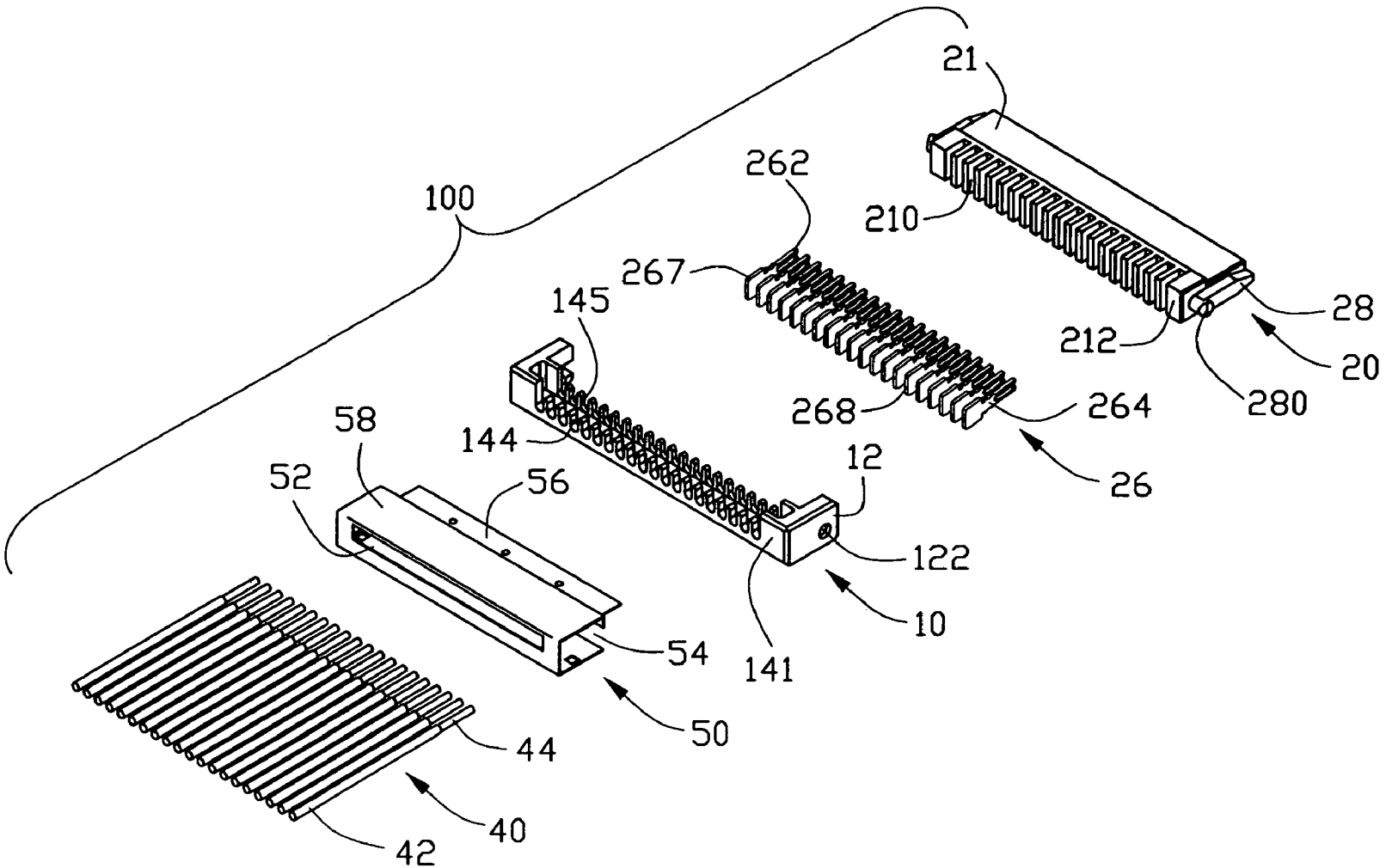
FIG. 2 is an exploded view of the cable connector assembly shown in FIG. 1.
Figure 4:
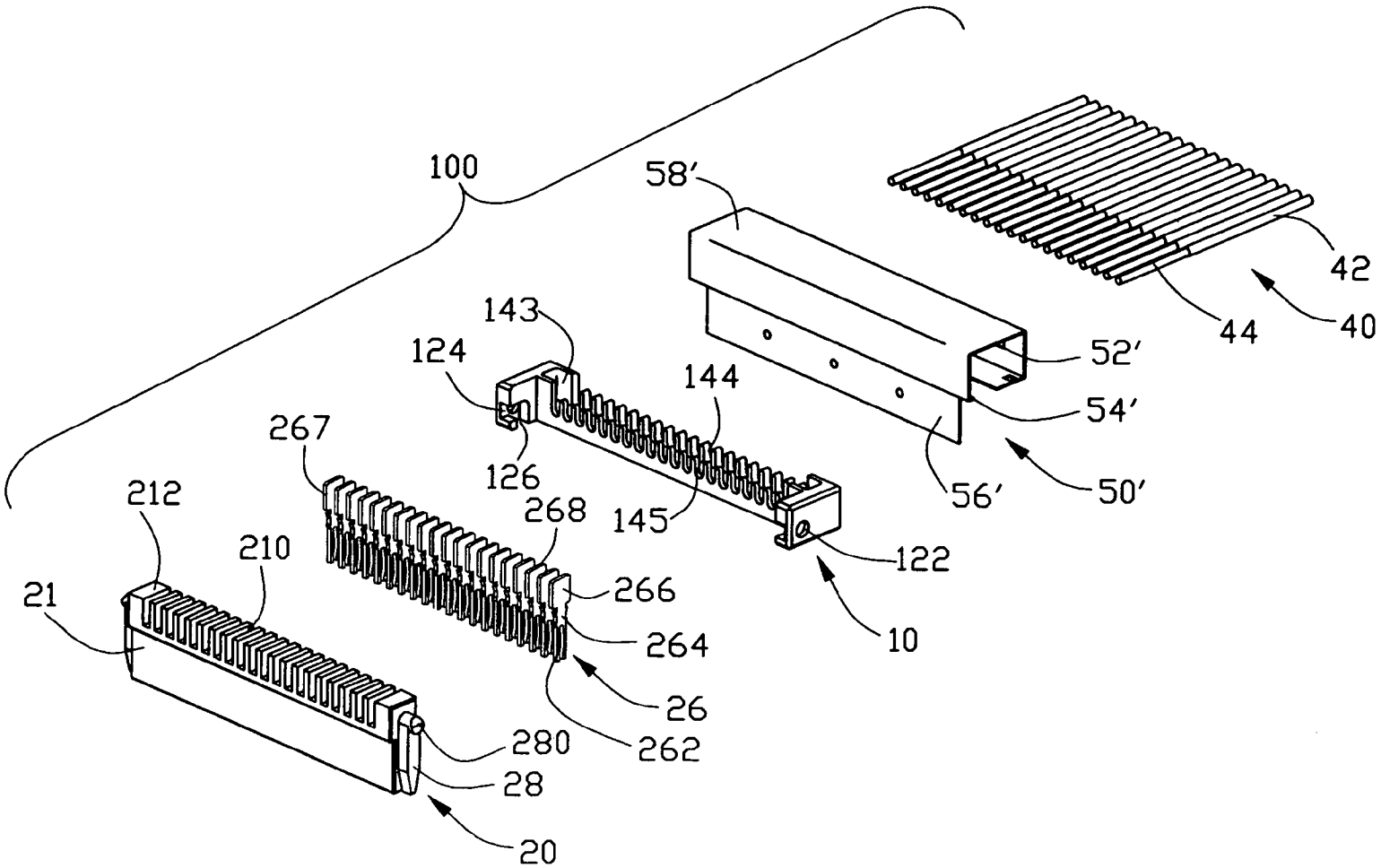
FIG. 4 is an exploded view of the cable connector assembly shown in FIG. 3.

Referring to FIGS. 2 and 4 in conjunction with FIG. 5, each terminal 26 comprises a retaining portion 264 with a plurality of barbs interferentially retained in the passageway 211 of the body 21, a forked engaging portion 262 extending forwardly from the retaining portion 264 into the passageway 211 for electrically connecting with a complementary connector and a mounting portion 266 extending backwardly from the retaining portion and retained in the corresponding notch 210.

Figure 7:
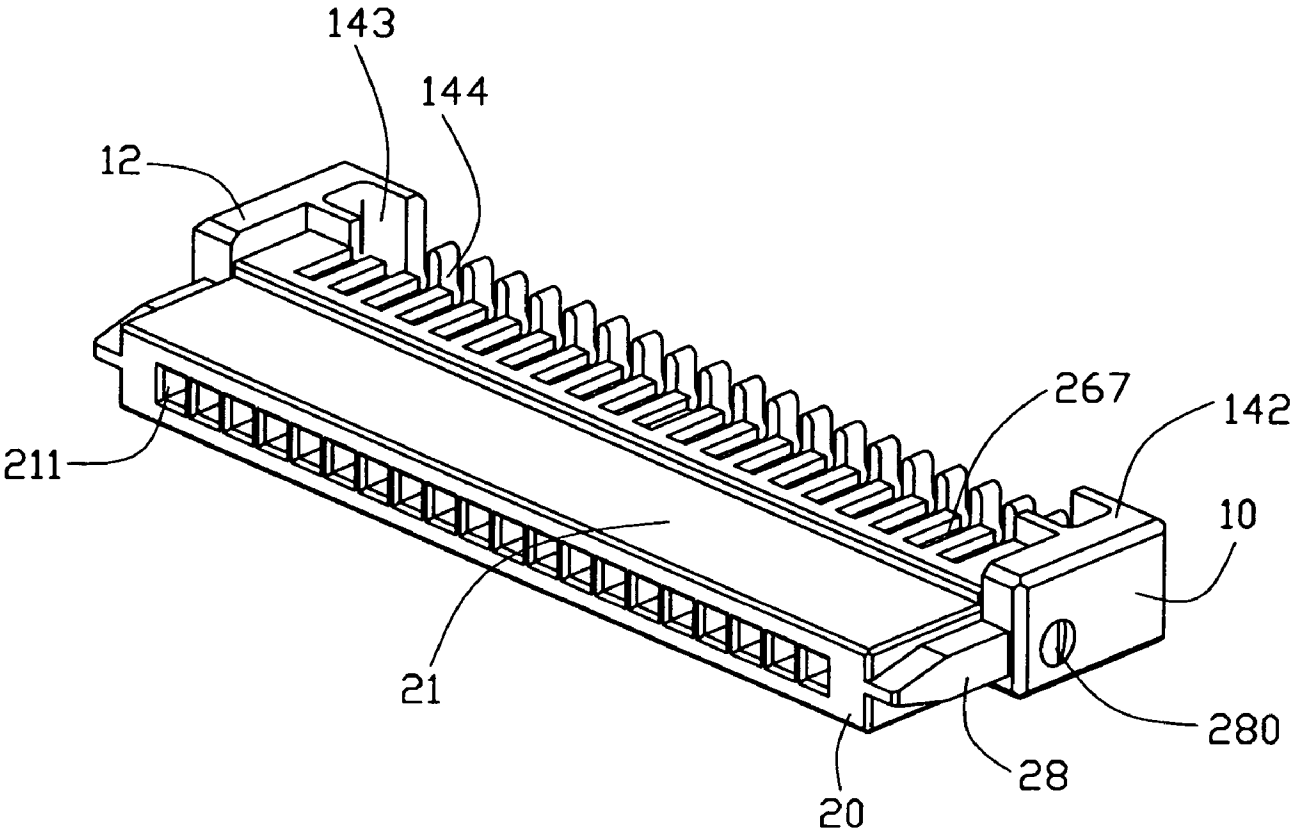
FIG. 7 is a perspective view of the first and second dielectric housings assembled in accordance with the first embodiment.

Referring to FIG. 7, when the first dielectric housing 20 is assembled onto the second dielectric housing 10 in accordance with a first embodiment, the body 21 of the first dielectric housing 20 is accommodated in the receiving space 11 with the rear face 212 thereof abutting against the front face 140 of the base 14, the notch 210 is aligned with the second channel 145. The first retention portion 28 engages with the second retention portion 12 with the rib received in the first recesses 124. The post 280 is received in corresponding hole 122 of the arm 12, whereby securing the engagement between the first and second dielectric housing 20, 30.

Figure 8:
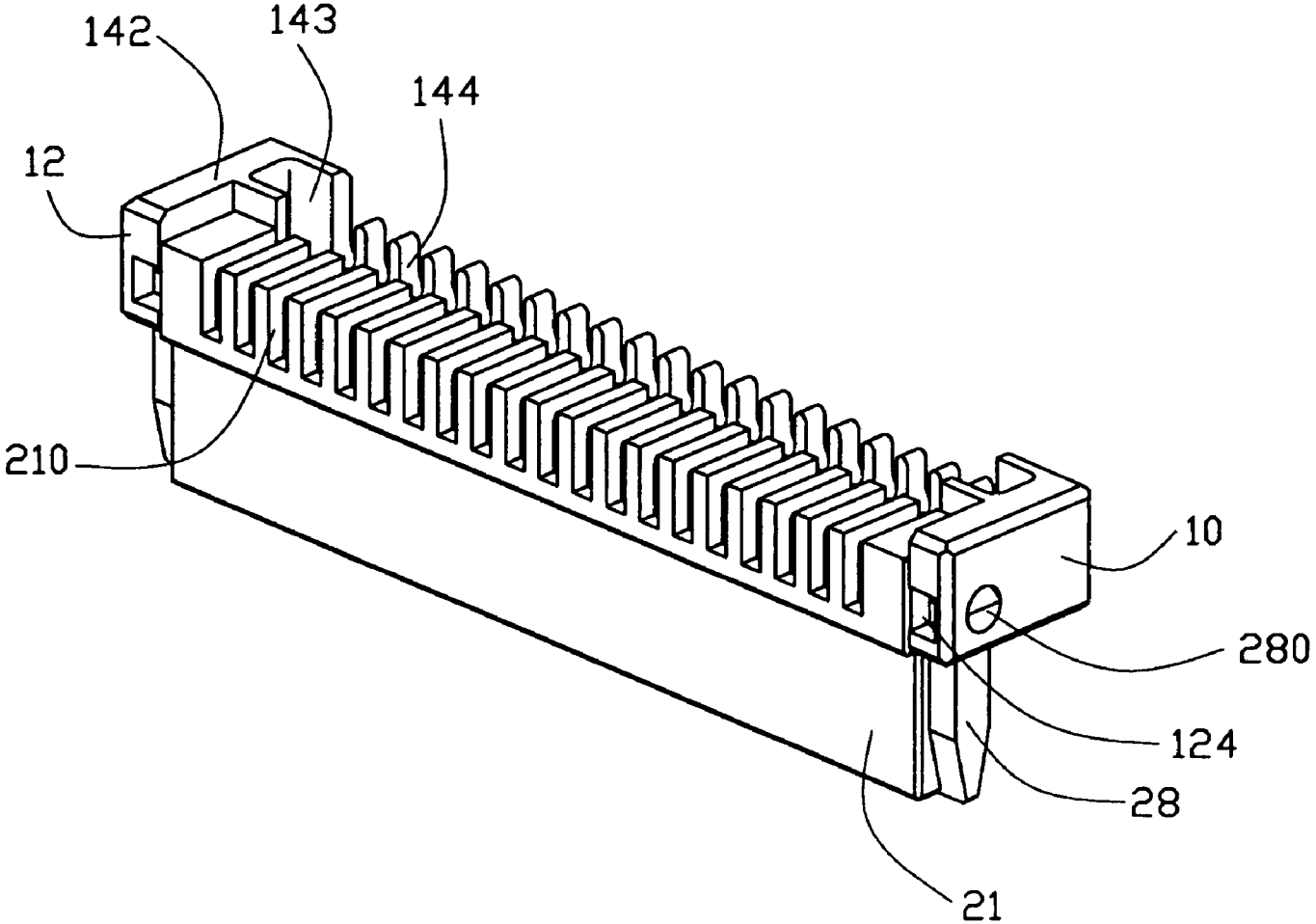
FIG. 8 is a perspective view of the first and second dielectric housing assembled in accordance with the second embodiment.

Referring to FIG. 8, it shows that the first dielectric housing 20 is assembled to the second dielectric housing 10 in accordance with a second embodiment of the present invention. The body 21 of the second dielectric housing 20 is accommodated in the receiving space 11, the notch 210 is aligned with the second channel 145. The first retention portion 28 engages with the second retention portion 12 with the ribs received in the second recess 126. The post 280 of the rib 28 engages with corresponding hole 122 of the arm 12, whereby securing the engagement between the first and the second dielectric housing 20, 30.

Referring to FIGS. 1, 2 and 7, the shield 50 in accordance with the first embodiment comprises a frame 58 enclosing the second dielectric housing 10 and having parallel front and rear walls, a pair of opposite rectangular openings 52, 54 respectively defined in the front and rear walls of the frame 58, a flange 56 extending forwardly from an edge of the opening 54. The rear face 141 of the base 14 abuts against the rear wall of the frame 58 with the first channels 144 communicating with the opening 52. The body 21 extends through the opening 54 with the flange 56 covering a side of the body 21. The cable 40 comprise a plurality of parallel wires 42 received in corresponding first and second channels 144, 145. Each wire 42 comprises a conductor 44 electrically soldered to a side edge 267 of the mounting portion 266 of the terminal 26. A direction in which the cable 40 extends is parallel to a mating direction of the cable connector assembly 100 with respect to a complementary connector in accordance with the first embodiment.

Figure 3:
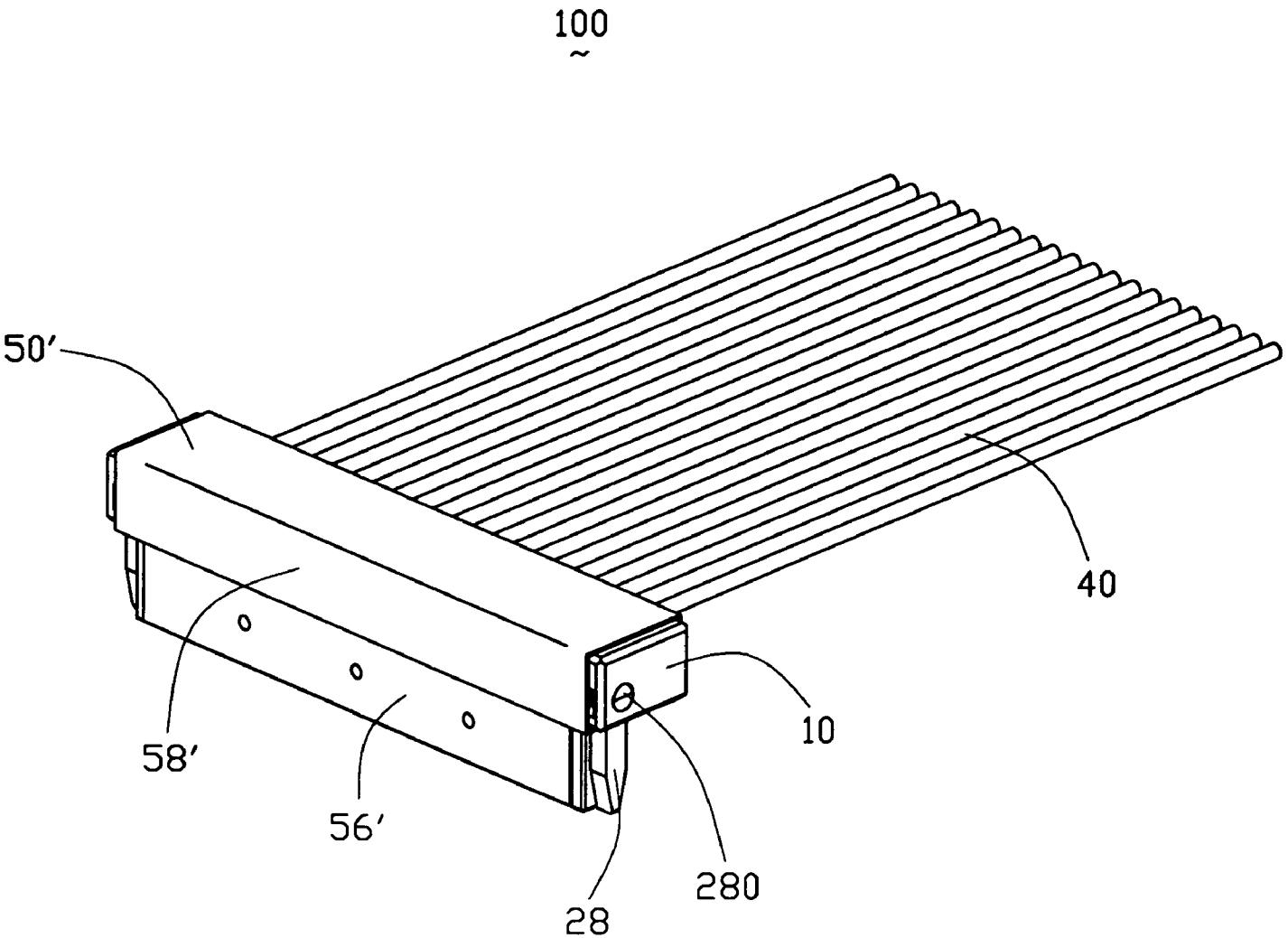
FIG. 3 is a perspective view of a cable connector assembly in accordance with a second embodiment of the present invention.

Referring to FIGS. 3, 4 and 8, a shield 50' in accordance with the second embodiment comprises a frame 58' enclosing the second dielectric housing 10 and having perpendicular rear and lower walls, a pair of rectangular openings 52', 54' respectively defining in the rear and lower walls of the frame 58', a flange 56' extending upwardly from an edge of the opening 54. The rear face 141 of the base 14 abuts against the rear wall of the frame 58' with the first channels 144 communicating with the opening 52'. The body 21 extends through the opening 54' with the flange 56' covering a side of the body 21. The wire 42 of the cable 40 comprises a conductor 44 electrically soldering to an end 268 of the mounting portion 266 of the terminal 26. A direction in which the cable 40 extends is perpendicular to a mating direction of the cable connector assembly in accordance with the second embodiment.

The cable connector assembly in accordance with the invention comprises the first and second dielectric housing separating with each other, the first housing are able to engage with the second dielectric housing at different angles, whereby the mating direction of the cable connector assembly with the complementary connector is formed at a different angle to the direction which the cable extends for a variety of requirement.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector for mating with a counter part electrical connector, comprising:

a first dielectric housing comprising a body and a first retention structure formed at opposite ends of the body, the body defining a plurality of passageways;

a second dielectric housing comprising a base and a second retention structure formed at opposite ends of the base, the second retention structure being engageable with the first retention structure at different angles;

a plurality of terminals received in corresponding passageways in the second housing; and a plurality of cables, each cable comprising a conductor passing through the second dielectric housing into the first dielectric housing electrically connecting with corresponding terminals; wherein the second retention structure is a pair of arms extending from the base; wherein each arm defines a first retention position and a second retention position being both engageable with the first retention structure; wherein the first retention structure is a pair of ribs, and wherein each arm define a first and a second recesses respectively at the first and second retention position; wherein the rib is formed with a post, and wherein each arm detines a hole engaging with the post and communicating with the first and second retention position.

2. An electrical connector for mating with a counter part connector, comprising:

a first dielectric housing comprising a body and a first retention structure thereof, the body defining a plurality of passageways;

a second dielectric housing comprising a base and a second retention structure formed, the second retention structure being mutually exclusively to be able to engageable with the first retention structure at different angles; and a plurality of terminals received in corresponding passageways, each of said terminals defining a mounting portion; and two different types metallic shells being mutually exclusively able to be attached to the assembled first and second housing, according to how said first and second retention structures are assembled together; further comprising a plurality of wires associated with the second housing, and electrically and mechanically connected respectively to the mounting portions of the corresponding terminals in an oriented manner according to how said first and second retention structures are assembled together.

* * * * *